US008383999B2

(12) United States Patent
Kotzian et al.

(10) Patent No.: US 8,383,999 B2
(45) Date of Patent: Feb. 26, 2013

(54) DEVICE FOR HEATING A SAMPLE BY MICROWAVE RADIATION

(75) Inventors: Heimo Kotzian, Graz (AT); Klaus-Jürgen Pendl, St. Ruprecht an der Raab (AT); Johannes Zach, St. Marein (AT); Rainer Zentner, Graz (AT)

(73) Assignee: Anton Paar GmbH, Graz (AT)

( * ) Notice: Subject to any disclaimer, the term of this patent is extended or adjusted under 35 U.S.C. 154(b) by 390 days.

(21) Appl. No.: 12/765,223

(22) Filed: Apr. 22, 2010

(65) Prior Publication Data

US 2010/0270291 A1 Oct. 28, 2010

(30) Foreign Application Priority Data

Apr. 24, 2009 (EP) ..... 09158777

(51) Int. Cl.
*H05B 6/70* (2006.01)

(52) U.S. Cl. ..... 219/690; 219/691; 219/694; 219/696; 219/697

(58) Field of Classification Search ..... 219/690, 219/691, 694, 696, 697
See application file for complete search history.

(56) References Cited

U.S. PATENT DOCUMENTS

| | | | | |
|---|---|---|---|---|
| 4,681,740 | A | 7/1987 | Commarmot et al. | 422/78 |
| 5,382,414 | A | 1/1995 | Lautenschläger | 422/186 |
| 5,837,978 | A | 11/1998 | Hatzakis, Jr. et al. | 219/702 |
| 6,097,015 | A * | 8/2000 | McCullough et al. | 219/686 |
| 2002/0027135 | A1 | 3/2002 | Fagrell et al. | 219/690 |
| 2002/0180555 | A1 * | 12/2002 | Harris | 333/125 |
| 2004/0069776 | A1 | 4/2004 | Fagrell et al. | 219/690 |
| 2006/0039838 | A1 * | 2/2006 | Barnhardt et al. | 422/186 |

FOREIGN PATENT DOCUMENTS

WO WO 99/17588 4/1999

* cited by examiner

*Primary Examiner* — Ajay K Arora
(74) *Attorney, Agent, or Firm* — Kusner & Jaffe

(57) ABSTRACT

The present invention concerns a device for heating a sample by microwave radiation comprising a source of microwave radiation, a first waveguide for guiding said microwave radiation to an applicator space adapted to receive said sample to be heated, wherein said applicator space is defined by a terminal portion of said first waveguide and an initial portion of a second waveguide extending from said terminal portion of said first waveguide and being arranged at an angle with respect to said first waveguide.

14 Claims, 1 Drawing Sheet

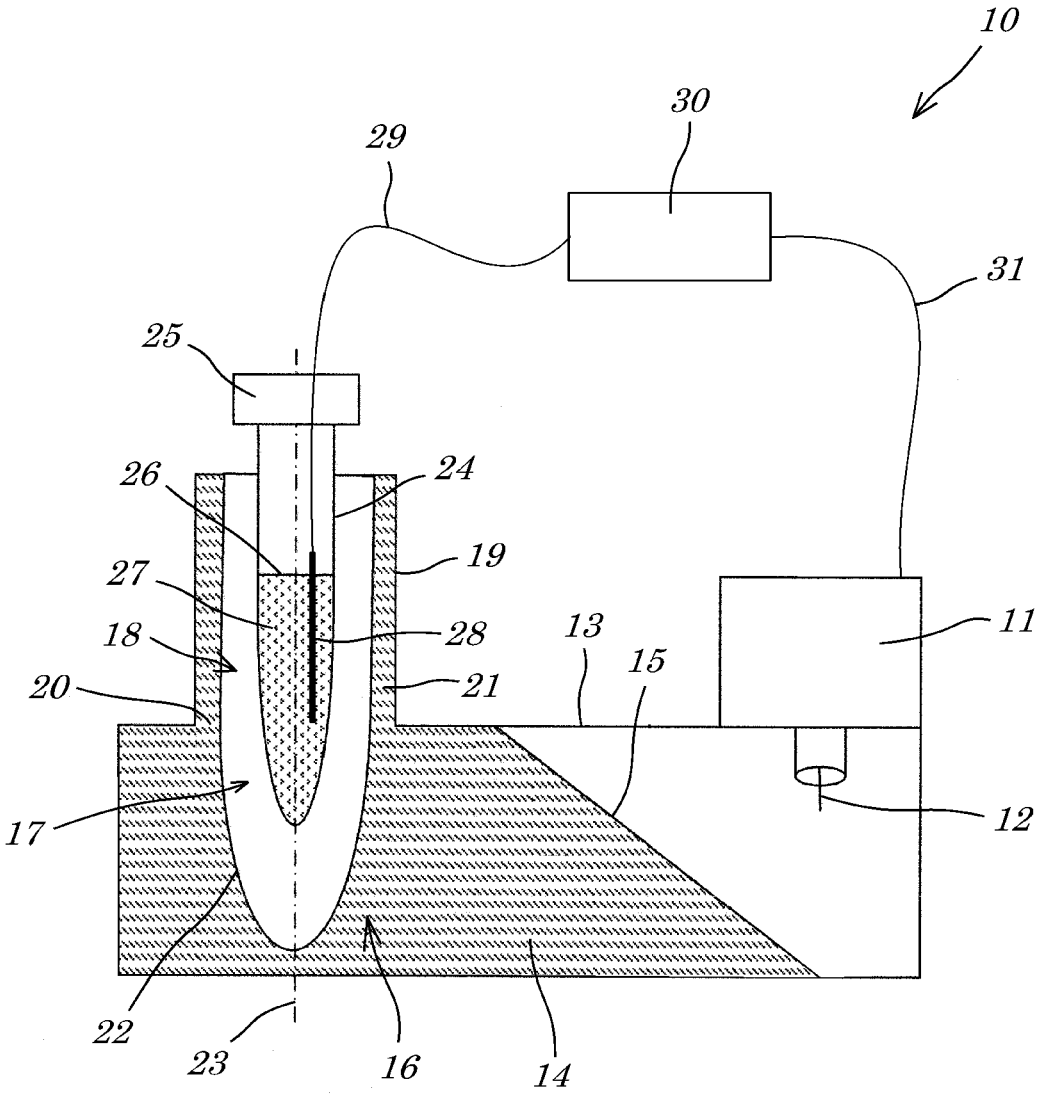
10
30
29
31
25
26
24
19
27
28
18
13
11
15
20
21
17
12
22
23
16
14

DEVICE FOR HEATING A SAMPLE BY MICROWAVE RADIATION

FIELD OF THE INVENTION

The present invention concerns a device for heating a sample by microwave radiation.

BACKGROUND OF THE INVENTION

In microwave-assisted chemistry, microwaves are used to initiate, drive, or otherwise enhance chemical or physical reactions. Generally, the term "microwaves" refers to electromagnetic radiation having a frequency within a range of about $10^8$ Hz to $10^{12}$ Hz. These frequencies correspond to wavelengths between about 300 cm to 0.3 mm Microwave-assisted chemistry is currently employed in a variety of chemical processes. Typical applications in the field of analytical chemistry include ashing, digestion and extraction methods. In the field of chemical synthesis, microwave radiation is typically employed for heating reaction materials, many chemical reactions proceeding advantageously at higher temperatures. In addition, when pressureriseable reaction vessels are used, many analytical or synthetical processes can be further enhanced by increasing the pressure in the vessel. Further, when, for example, digestion methods for analytical purposes are used, the generation or expansion of gases inside the vessel will necessarily increase the internal pressure. Thus, in order to ensure that no reaction products are lost for subsequent analysis, vessels must be used which are able to withstand high internal pressures in these cases.

Usually, most microwave-assisted reactions are performed in open or, preferably, in sealed vessels at temperatures rising up to 300° C. Typical pressures range from below atmospheric pressure, e.g. in solvent extraction processes, up to 100 bar, e.g. in digestion or synthesis processes.

Microwave-assisted chemistry is essentially based on the dielectric heating of substances capable of absorbing microwave radiation, which is subsequently converted into heat.

Many apparatuses and methods currently employed in microwave-assisted chemistry are based upon conventional domestic microwave ovens operating at a frequency of 2.45 GHz. As magnetrons operating at this frequency are produced in large quantities for domestic appliances, microwave apparatuses for microwave-assisted chemistry using such magnetrons can be manufactured at relatively low cost.

The applicator cavity of heating devices based on domestic microwave ovens is usually a multi-mode resonance cavity in which the spatial energy distribution is determined by an interference of standing waves of different longitudinal and transverse modes of the microwave field. Accordingly, an inhomogeneous field distribution results leading to so-called "hot spots" and "cold spots", respectively. In order to ensure homogenous heating of the sample arranged within a multi-mode resonance cavity, the sample to be heated is usually arranged on a turntable which is rotated during the heating process in order to level the overall energy absorbed throughout the sample.

It is also known that depending on the sample loading in the cavity and on the dielectric characteristics (permittivity) of the sample, the balance between the electromagnetic modes within a multi-mode cavity and consequently the overall distribution of microwave energy within the cavity will be modulated. This will usually not pose a particular problem, because the rotation of the sample on the turntable during the heating process will still ensure a sufficient balancing of the overall energy absorbed by the sample. Consequently, except for a turntable, no special means are usually employed in a multi-mode cavity to compensate for field distribution changes caused by varying load characteristics.

Multi-mode applicator cavities based on household microwave ovens have a rather large sample volume and are consequently particularly suited to heat larger samples. For smaller sample volumes, other devices, namely so-called mono-mode or single-mode applicators are usually employed for microwave heating in chemical analytics or synthesis. A typical single-mode microwave heating device used is for instance described in U.S. Pat. No. 4,681,740. Such a typical single-mode microwave applicator used in chemical synthesis or analysis comprises a magnetron for generating microwave radiation, typically operating at a frequency of 2.45 GHz, having an antenna which extends into one end of an hollow rectangular waveguide. At microwave frequencies of 2.45 GHz, a so-called WR340 rectangular waveguide having internal dimensions of 86×43 mm, is commonly used, in which the $TE_{10}$ mode of the microwave field can propagate. At the opposite end of the rectangular waveguide, a resonant applicator cavity is provided which is adapted to accommodate a sample vessel. Devices such as the microwave heating device of U.S. Pat. No. 4,681,740, are provided with a circular opening in the upper wall of the applicator cavity through which the sample vessel with the sample to be heated can be inserted into the cavity. A metallic cylindrical chimney extends above the opening. The diameter of the opening and the height of the chimney are selected such that no microwave radiation can escape from the waveguide through the opening into the chimney As compared to multi-mode cavities, single-mode applicators tuned to resonance have the advantage that when operating at similar power levels, higher field intensities and a more even energy distribution throughout the sample can be achieved. In addition, as the ratio of sample volume to cavity volume is increased, the overall energy yield is also improved. However, in order to achieve these advantages, a good impedance matching of the impedance of the rectangular waveguide and the impedance of the applicator cavity has to be achieved in order to obtain an efficient energy transfer into the sample. However, as noted above, the impedance of the applicator cavity is influenced by the sample to be heated itself. Consequently, the heating of different samples having different permittivity or even the heating of a single sample which has a changing permittivity throughout the heating process, as well as using samples with different sample volumes, will effect the impedance characteristics of the cavity/sample-system and may therefore deteriorate the initial matching to the impedance of the waveguide.

In prior art, several solutions have been suggested to improve the absorption of the microwave radiation by the sample within an applicator cavity. For instance, in U.S. Pat. No. 5,382,414, a lifting device comprising a piston rod is described which allows to change the height of a plate on which the sample is arranged within the applicator cavity. U.S. Pat. No. 5,837,978 describes a multi-mode cavity, where resonance conditions can be improved by adapting the height of the applicator cavity to changing process conditions. WO 99/17588 A1 describes a device for controlling the feeding of microwave power through a waveguide into a microwave heating appliance by movably arranging a conductor member in the waveguide in order to affect the mode pattern of the microwave radiation transported through the waveguide. In US 2004/0069776, a waveguide comprising a rotatable deflector is described, which is controlled via a dummy load in order to maximize energy transmission into the sample cavity. Accordingly, prior art devices require sophisticated adjusting and control means to adapt microwave transmission to varying permittivity conditions in the applicator space. Consequently, the provision of such control systems leads to a considerable increase of the overall manufacturing costs of the microwave heating devices of prior art.

SUMMARY OF THE INVENTION

It is therefore an object of the present invention to provide a simple and cost-effective device for heating a sample by microwave radiation, which maintains effective heating conditions even for samples of different permittivity or samples whose permittivity changes during the heating process. Effective microwave absorption shall also be maintained for varying sample volumes, e.g. due to the use of sample vessels having a different cross-section and/or different filling levels. It is also an object of the present invention to provide a device which is particularly suited to heat small sample volumes, e.g. sample volumes in the range of 1 to 100 ml, particularly in the range of 2-20 ml. The device of the invention shall also allow the use of pressurizable ample vessels thus allowing a temperature increase for a given absorption of microwave energy within the sample.

According to the invention, these objects are achieved by providing a device for heating a sample by microwave radiation comprising a source of microwave radiation, a first waveguide for guiding said microwave radiation to an applicator space adapted to receive the sample to be heated, wherein the applicator space is defined by a terminal portion of the first waveguide and an initial portion of a second waveguide extending from said terminal portion of said waveguide and being arranged at an angle with respect to said first waveguide. In this respect a "terminal portion" simply denotes a segment of the first waveguide arranged at or near the end of the waveguide opposite to the source of microwave radiation. This does not exclude the possibility that the first waveguide extends a certain amount beyond the junction of first and second waveguide.

It has surprisingly been found by the present inventors that by distributing the applicator space, in which the sample to be heated can be arranged, across two adjacent portions of two distinct waveguides, it is possible to design a self-adjusting applicator space which will adapt the electromagnetic field distribution in response to permittivity changes within the applicator space such that an efficient absorption of microwave energy by the sample is maintained throughout the heating process.

As the applicator space is self-adapting to varying permittivity conditions without employing moving parts, no sophisticated mechanical or electronic control means are required to maintain high levels of microwave absorption by the sample to be heated. Consequently, the present invention provides a simple, compact and cheap device for heating samples of varying permittivity by microwave radiation.

In order to obtain a self-regulating applicator space, the second waveguide is preferably adapted to block or dampen the propagation of microwave radiation from the first waveguide into the second waveguide if no sample is present in the portion of the applicator space defined by said second waveguide and to improve propagation of microwave radiation from said first waveguide into said second waveguide if a sample is present in the portion of the applicator space defined by the second waveguide. In the latter case, microwave radiation can penetrate into the second waveguide so that not only the sample volume arranged within the first waveguide is effectively heated but also the sample volume arranged in the portion of the applicator space defined by the second waveguide. Accordingly, if, e.g., a sample vessel with a low filling level of the sample is inserted into the applicator space, the microwave cavity having high field strength is essentially defined by the terminal portion of the first waveguide. If the filling level is increased so that the sample to be heated extends into the second waveguide, the electromagnetic field pattern is varied due to the changing permittivity within the applicator space such that microwave radiation can now penetrate into the second waveguide and heat the corresponding sample volume accordingly. By suitably tailoring the first and second waveguide, the device of the present invention is self-adapting to a changing sample level within a sample vessel inserted into the applicator space and similar heating rates are achievable with varying filling levels.

In a preferred embodiment of the invention, the angle between the first waveguide and the second waveguide is essentially 90°, i.e. the second waveguide extends essentially perpendicular from the terminal portion of the first waveguide.

In a preferred embodiment, the first waveguide is adapted to transmit a single mode of the microwave radiation generated by the source of microwave radiation, e.g. a magnetron operating at 2.45 GHz. Accordingly, the overall design of the device of the present invention is similar to single-mode microwave applicators known in the art, such as for instance described in U.S. Pat. No. 4,681,740.However, while in prior art the applicator space for heating the sample is arranged within the rectangular waveguide only, the present invention suggests to extend the applicator space into a second waveguide, which extends preferably perpendicular from the first waveguide. Especially, in contrast to the present invention, the chimney provided above the applicator space of the device of U.S. Pat. No. 4,681,740 does not act as a waveguide.

The first and second waveguides can have any suitable cross-sectional shapes and dimensions adapted to transmit the desired modes of microwave radiation. Preferably, the first and second waveguide are rectangular or circular waveguides. In a preferred embodiment of the invention, the first waveguide is a rectangular waveguide, preferably adapted to transmit the $TE_{10}$ mode of the microwave radiation generated by the magnetron.

Preferably, the second waveguide extending from the terminal portion of the first waveguide is a circular waveguide. According to a preferred embodiment, the dimensions of the second waveguide are selected such that without sample present in the applicator space defined by the initial portion of the second waveguide, propagation of microwave radiation into the second circular waveguide is prohibited. Once a sample having a suitable dielectric constant, is inserted into the applicator space and extends into the second waveguide, the characteristics of the second waveguide are changed such that propagation of microwave radiation, e.g. the $TE_{11}$ mode, into the second waveguide is possible. For instance, in an air filled circular waveguide having an inner diameter of 71.7 mm, the $TE_{11}$ mode of 2.45 GHz microwave radiation will propagate. According to the invention, the inner diameter of the circular second waveguide would be selected smaller than the 71.7 mm so that the $TE_{11}$ will not propagate in the second waveguide unless a sample with increased relative permittivity is present.

In a preferred embodiment of the invention, the first waveguide and/or the second waveguide is/are at least partially filled with dielectric materials exhibiting low absorbance for the microwave radiation generated by the source of microwave radiation. By filling the rectangular waveguide with a suitable filling material, the applicator system can be adapted to small loads.

Preferable filler materials comprise microwave transparent materials having an increased relative permittivity. Preferable filler materials comprise microwave transparent plastic materials such as polyolefins, for instance polyethylene having a relative permittivity $\epsilon_r$ ranging from 2.25 to 2.9, or fluoropolymers, for instance polytetrafluoroethylene (PTFE) having a relative permittivity $\epsilon_r$=2.1. Other materials, e.g. plastic materials such as PEEK, resins, ceramic materials, glass materials, or liquid materials such perfluoropolyethers can also be used. As the filler material shortens the propagated wavelength by a factor of $1/\sqrt{\epsilon_r'}$ (with $\epsilon_r'$ denoting the real part of the complex relative permittivity of the filler material) as compared to the wavelength in air, the usual WR340 rectangular waveguide can be scaled down with a magnetron still operating at 2.45 GHz so that compact overall dimensions of the device can be achieved. If the rectangular waveguide is filled for instance with PTFE, a rectangular waveguide having internal dimensions of 61×43 mm is preferably used for the propagation of the $TE_{10}$) mode in the rectangular waveguide.

If a magnetron is used as a source of microwave radiation, an antenna of the magnetron will usually extend into the rectangular waveguide. During operation, the temperature of the antenna may reach high values so that a direct contact between the antenna and the filler material should be avoided. Accordingly, it is preferred that the rectangular waveguide is not completely filled with filler material, but that at least a certain portion of the waveguide in the vicinity of the antenna is filled with air. To avoid reflections of the propagating microwave radiation when reaching the segment of the waveguide which is filled with filler material, the surface of the filler material is usually slanted into the direction of microwave propagation so that a wedge-shaped end of the filler material is obtained within the waveguide. In addition, within the applicator space, an open space is provided within the filler material to allow insertion of the sample vessel. Filler wedge, filler material and the profile of the open space are designed such that a peak of the electric field and the sample volume coincide within the sample space.

It has surprisingly been found that the provision of a suitable filler material at least in the first waveguide surprisingly maintains improved impedance matching in the applicator cavity even if the permittivity of the sample changes for small loads.

Consequently, in a preferred embodiment, the applicator space is adapted to receive the sample vessel having external diameters ranging from 5 to 50 mm, preferably from 10 to 35 mm and having sample volumes ranging from 1 to 100 ml, preferably from 1 to 50 ml and particularly preferred from 2 to 20 ml.

The particular design of the device of the present invention, in particular with respect to filler materials, their arrangement in the first and/or second waveguide, and the shape of the internal wall of the applicator cavity, can be optimised using commercially available simulation software, e.g. HFSS™, a 3D full-wave electromagnetic field simulation commercialised by Ansoft LLC, Pittsburgh, Pa., USA. The design will preferably be based on a solvent having low microwave absorption, e.g. tetrahydrofuran (THF) or toluene using a minimal design volume of e.g. 3 ml. The optimisation process ensures that with increasing sample volume (filling level), the area of high field strength will extend into the second waveguide thus ensuring effective and uniform heating of the whole sample.

In a preferred embodiment, the sample vessel is pressurizable. This can e.g. be obtained by providing the second cylindrical waveguide with a lid which acts directly on the upper end of the sample vessel or on a separate lid of the sample vessel.

In a preferred embodiment, the optimised filler arrangement in the applicator space has a cup-like form essentially surrounding the sample vessel thus forming a shatter protection which is particularly useful if a pressurized sample vessel is employed which may break and scatter during the heating process. In addition the filler material prevents corrosion of the waveguides if a sample vessel comprising aggressive samples should break.

Although the device of the present invention can be adapted to uniformly heat samples of varying filling levels, in a preferred embodiment, the device of the invention further comprises means for stirring the sample vessel in order to improve the homogenous heating within the volume of the sample within the vessel. Preferably, a magnetic stirring element is immersed in the sample vessel and external magnetic actuators are provided to rotate the magnetic stirring element.

With the device of the present invention, very high heating rates can be achieved. Thus, on the one hand, even for samples having a low absorption rate for microwave radiation, no additional absorbers known from the art, such as small silicon carbide absorbers immersed in the sample to be heated, are required. On the other hand, in certain applications where a particular target temperature has to be attained, a precise control of the heating process can be necessary. For instance, in order to obtain reproducible results in chemical analysis and even more in chemical synthesis, it is important to quickly achieve a certain target temperature without overshooting the target temperature because in many cases an overshooting of only a few degrees might even destroy certain components involved in the synthesis process.

Consequently, in accordance with a preferred embodiment, means for measuring the sample temperature of the sample vessel are provided and preferably, the device of the invention also comprises means for controlling the temperature of the sample. Due to the small sample vessels employed, distributed temperature sensing systems using fibre optics are usually preferred. Advantageously, the means for controlling the temperature of the sample are adapted to control the output power of the source of microwave radiation such that a quick and reliable heating of the sample without overshooting the desired target temperature is achieved.

The invention will now be described in more detail making reference to preferred embodiments depicted in the attached drawings.

BRIEF DESCRIPTION OF THE DRAWINGS

In the drawings:

FIG. 1 is a schematic view of a microwave heating device of the invention.

DETAILED DESCRIPTION OF THE INVENTION

FIG. 1 depicts a preferred embodiment of the device 10 for heating a sample by microwave radiation in accordance with the present invention. The device 10 comprises a magnetron 11 for a generating microwave radiation, for instance operating at a frequency of 2.45 GHz. The magnetron 11 comprises an antenna 12 extending into a rectangular waveguide 13. Waveguide 13 is partially filled with a dielectric filler material 14, for instance polyethylene or PTFE. The filler material 14 has a front face 15 facing the antenna 12 which is slanted into the direction of propagation of the microwave radiation emitted by antenna 12. Accordingly, microwave radiation can penetrate into the filler material 14 without being reflected back to the antenna 12. In a terminal portion 16 of the rectangular waveguide 13, an applicator space 17 is provided which extends from the terminal portion 16 of the first waveguide 13 into an initial portion 18 of a second waveguide 19 extending from the terminal portion 16 of the first waveguide 13. The second waveguide 19 is a circular waveguide arranged essential perpendicular to the first waveguide 13. The second waveguide 19 has a diameter 20 selected such that propagation of microwaves from the first waveguide 13 into the second waveguide 19 is prevented, if no sample is present in the initial portion 18 of the second waveguide 19.

As can be taken from FIG. 1, a dielectric filler material 21 is also provided within the second, cylindrical waveguide 19. The filler material 21 can be the same or a different filler material as the filler material 14 arranged in the first waveguide 13. Also, more than one filler material can be used in each of the first and second waveguide, respectively.

The shape of an inner surface 22 of the filler material(s) 14, 21 defines the applicator space 17 into which a sample vessel can be inserted. The shape of the inner surface 22 is adapted to maintain an electromagnetic field pattern of high intensity within the sample volume applicator space 17 if a sample of varying permittivity is present in the applicator space 17 defined by terminal portion 16 of the first rectangular waveguide 13 and to optimise transmission and distribution of the microwave field into the second, cylindrical waveguide 19 if a sample is present in the portion 18 of the sample space defined by the second waveguide 19. In the area of the terminal portion 16 of the first waveguide 13, the inner surface 22 of the applicator space 17 has essentially a shape adapted to accommodate the sample vessel. Usually, the applicator space 17 will have a longitudinal axis 23 which coincides with the longitudinal axis of the second waveguide 19. In the area of the initial portion 18 of the second waveguide 19, the surface 22 essentially extends parallel to the inner wall of the second waveguide 19.

A pressurizable sample vessel 24 closed by a lid 25 is arranged in the applicator space. As can be taken from FIG. 1, the filling level 26 of a sample 27 arranged in sample vessel 24, extends above the portion 16 of the applicator space 17 defined by the first rectangular waveguide 13 into the portion 18 of applicator space 17 defined by the circular second waveguide 19.

As noted above, the internal diameter 20 of the second waveguide 19 is selected such that propagation of microwave radiation is confined to the rectangular waveguide 13 if no sample is present in the applicator space 17 or if the filling level 26 of sample 27 does not exceed the portion of the applicator space 17 defined by the rectangular waveguide 13. However, in a situation as depicted in FIG. 1, microwave radiation can penetrate into the second, cylindrical waveguide 19 and effectively heat the upper regions of sample 27 as well.

A fibre optical temperature sensor 28 is immersed in the sample 27 to regularly transmit the temperature of the sample via line 29 to a micro-processor 30 which in turn controls the output power of magnetron 11 via control line 31.

Having described the invention, the following is claimed:

1. A device for heating a sample by microwave radiation comprising:

a source of microwave radiation, a first waveguide for guiding said microwave radiation to an applicator space adapted to receive said sample to be heated, wherein said applicator space is defined by a terminal portion of said first waveguide and an initial portion of a second waveguide extending from said terminal portion of said first waveguide and being arranged at an angle with respect to said first waveguide, said second waveguide adapted to block or dampen propagation of microwave radiation from said first waveguide into said second waveguide if no sample is present in the portion of said applicator space defined by said second waveguide, and said second waveguide adapted to improve propagation of microwave radiation from said first waveguide into said second waveguide if a sample is present in the portion of said applicator space defined by said second waveguide.

2. The device of claim 1, wherein said second waveguide extends essentially perpendicular from said terminal portion of said first waveguide.

3. The device of claim 1, wherein said first waveguide is adapted to transmit a single mode of said microwave radiation generated by said source.

4. The device of claim 1, wherein at least one of said first waveguide and said second waveguide is a rectangular waveguide.

5. The device of claim 1, wherein at least one of said first waveguide and said second waveguide is a circular waveguide.

6. The device of claim 1, wherein at least one of said first waveguide and said second waveguide is at least partially filled with dielectric materials exhibiting low absorbance for said microwave radiation.

7. The device of claim 6, wherein said dielectric materials are selected from plastic materials.

8. The device of claim 1, wherein said applicator space is adapted to receive a sample vessel.

9. The device of claim 8, wherein said sample vessel is pressurizable.

10. The device of claim 8, comprising means for stirring the sample in said sample vessel.

11. The device of claim 8, comprising means for measuring the sample temperature in said sample vessel.

12. The device of claim 11, comprising means for controlling the temperature of said sample.

13. The device of claim 11, where said means for controlling the temperature of said sample are adapted to control the output power of said source of microwave radiation.

14. The device of claim 7, wherein said plastic materials are selected from the group consisting of the following: polyolefins and fluoropolymers.

* * * * *